US009299527B2

(12) United States Patent
Chang

(10) Patent No.: US 9,299,527 B2
(45) Date of Patent: Mar. 29, 2016

(54) GAS DISCHARGE TUBES FOR SURCHARGE SUPPRESSION

(71) Applicant: Chang Gung University, Tao-Yuan (TW)

(72) Inventor: Liann-Be Chang, Tao-Yuan (TW)

(73) Assignee: CHANG GUNG UNIVERSITY (TW)

( * ) Notice: Subject to any disclaimer, the term of this patent is extended or adjusted under 35 U.S.C. 154(b) by 531 days.

(21) Appl. No.: 13/728,517

(22) Filed: Dec. 27, 2012

(65) Prior Publication Data

US 2014/0184064 A1 Jul. 3, 2014

(51) Int. Cl.
*H01J 7/44* (2006.01)
*H01J 9/24* (2006.01)

(52) U.S. Cl.
CPC .... *H01J 7/44* (2013.01); *H01J 9/24* (2013.01)

(58) Field of Classification Search
USPC ..... 445/35, 39
See application file for complete search history.

(56) References Cited

U.S. PATENT DOCUMENTS 3,035,201 A * 5/1962 Meirion ..... H01J 17/40 313/601
3,629,650 A * 12/1971 Patrick ..... H05B 41/04 315/177
3,659,150 A * 4/1972 Laupman ..... H05B 41/046 315/106
3,992,643 A * 11/1976 Vital ..... G03B 15/03 313/234
4,160,186 A * 7/1979 Kerekes ..... H01J 61/36 174/50.53
4,164,686 A * 8/1979 Vital ..... G03B 15/03 315/151
4,168,453 A * 9/1979 Gerhard ..... H05B 41/046 315/225
4,311,942 A * 1/1982 Skeist ..... H01J 5/48 313/156
4,538,277 A * 8/1985 Benett ..... H01S 3/0975 315/41
4,973,282 A * 11/1990 Berti ..... H01J 61/0672 313/288
5,042,139 A * 8/1991 Farrall ..... H01F 41/10 228/160
5,100,821 A * 3/1992 Fay ..... H03K 17/6874 29/623.5
5,610,477 A * 3/1997 Ivanov ..... H01J 17/30 313/234
7,141,933 B2 * 11/2006 Ball ..... H05B 41/2827 315/255
7,250,726 B2 * 7/2007 Ball ..... H05B 41/2827 315/210
7,511,431 B2 * 3/2009 Lesch ..... H01J 61/34 313/634
7,591,700 B2 * 9/2009 Lee ..... H01J 9/06 219/121.6
7,750,570 B2 * 7/2010 Kroes ..... H05B 41/08 313/567

* cited by examiner

*Primary Examiner* — Tung X Le
*Assistant Examiner* — Srinivas Sathiraju
(74) *Attorney, Agent, or Firm* — Volpe and Koenig, P.C.

(57) ABSTRACT

An novelly designed gas discharge tube (GDT) comprising at least two electrodes and at least one hollow insulating ring fastened to at least one of the electrodes, wherein the hollow insulating ring has an inductive property or a variable resistance property, thereby the new gas discharge tube can provide another possibility of a circuit design.

6 Claims, 5 Drawing Sheets

GAS DISCHARGE TUBES FOR SURCHARGE SUPPRESSION

FIELD OF THE INVENTION

The present invention relates to the field of gas discharge tubes including gas discharge tubes, spark gaps, switching spark gaps and triggered spark gaps, used in various applications, such as capacitive discharge circuits, communications networks, power systems and information systems and the like.

BACKGROUND OF THE INVENTION

When an electronic equipment is electrically connected to a power line, an antenna, or the like device providing a long signal, it is exposed to transient phase generated by an induction, caused by lightnings or electromagnetic pulses. A gas discharge tube protects the equipment from being damaged by absorbing the energy in the transient phase or by connecting it to ground. Gas discharge tubes are required to be self-recovering, are capable of handling repetitive transients and must function not only without delay but not being too sensitive to cause improper actions in normal operation. These properties should remain unchanged over time, and further, a gas discharge tube should be suitable for mass production with high and uniform quality.

Gas discharge tubes are used for protecting electronic equipment and are also frequently used as switching devices in power switching circuits, for example, in automotive gas-discharge headlights products. Other application are telecommunications and data communications, audio/video equipments, power supplies, welding equipments, electronic igniters for gas heating, architectural securities and military applications and the like.

Early gas discharge tubes included two solid graphite electrodes, separated by a mica layer. A modern conventional gas discharge tube usually includes two end electrodes plus one optionally additional electrode in the form of a center electrode plus one or two hollow cylindrical insulators, made of an electrically insulating material such as a ceramic, a suitable polymer, a glass or the like. As a usual rule, the insulator in a dual-electrode gas discharge tube is soldered to the end electrodes at two sides, joining them hermetically.

For example, the manufacturing process of a gas discharge tube has the following steps: sealing the components of the tube in a light gas at a suitable temperature and at atmospheric pressure in substantial, reducing the external pressure of the tube below atmospheric pressure while simultaneously lowering the temperature to such extent that the heavy gas can not cause diffusions or permeate the tube walls, and the enclosed light gas can diffuse or effuse through the tube walls. Thus it causes a reduction in the total gas pressure inside the tube.

Furthermore, an outside coating of the gas discharge tube has been disclosed, wherein a tin coating is applied to the electrodes, and an annular protective coating is applied to the ceramic insulator. The protective coating is formed from an acid-resistant and a heat-resistant colorant or a varnish which is continuous in the axial direction of the gas discharge tube. In addition, tin-coated leads can be coupled to the electrodes.

Power gas discharge tubes are for protection of electrical equipments against super-voltages and have high current capacity, which spark gap gas discharge tube comprises two carbon electrodes each having a hemispherical configuration and an insulating porcelain housing, whereby the carbon electrodes contains vent holes to the inner thereof to transfer arcs to an inner durable electrode material.

Sum up the above, there's no relevant disclosure of how to make gas discharge tubes inductive.

SUMMARY OF THE INVENTION

The object of the present invention is aimed to manufacture gas discharge tubes with an inductive property or a variable resistance property for all relevant fields of application. The gas discharge tubes, compared to other gas discharge tubes, show not only the same properties of gas discharge tubes but an inductive property or a variable resistance property.

This object is achieved by providing a new insulating ring design with an inductive property or a variable resistance property and an insulating ring in a hollow configuration, while maintaining the gap distance of electrodes.

In particular, the invention relates to an insulating ring with an inductive property or a variable resistance property having an extended length compared to its height thereby providing a long distance to any possible leakage current. The gas discharge tube includes at least two electrodes and at least one hollow insulating ring fastened to at least one of the electrodes, wherein the insulating ring has a spiral conductor, a variable resistance layer, a variable resistance chip or a chip inductive configuration on at least one of the insulator surfaces facing inward and/or outward, whereby providing the gas discharge tube with an inductive property or a variable resistance property.

At a certain voltage of operation, the required length of the insulating ring surfaces for avoiding a leakage current on the surfaces of the outside and the inside can make a plump variation depending on different conditions such as the ratio of the inside and outside gas pressure of the hermetically sealed component.

High-voltage insulators used for high-voltage power transmission are made from glass, porcelain, or composite polymer materials. Porcelain insulators are made from clay, quartz or alumina and feldspar, and are able to be covered with a smooth glaze to shed dirt. For some electric utilities, polymer composite materials have been used for some types of insulators which are made of the fiber reinforced plastic or consist of the silicone rubber. Composite insulators are less costly, lighter weight, and they have excellent hydrophobic capability. This combination makes them ideal for use in polluted areas.

DETAILED DESCRIPTION OF THE PREFERRED EMBODIMENT

As used herein the term "ring" means a plump polygonal hollow configuration. Thus the ring may take the form of a circle, oval, or polygonal (such as triangular, quadratic, pentagonal, hexagonal, heptagonal, and octagonal) or the like.

As used herein the term "insulator" or "insulating means" means an object being non-conductive with regard to electrical currents. Such objects are normally produced of aluminum oxide, other porcelain qualities, glass, plastic, composite material or other insulating material.

Figure 1:
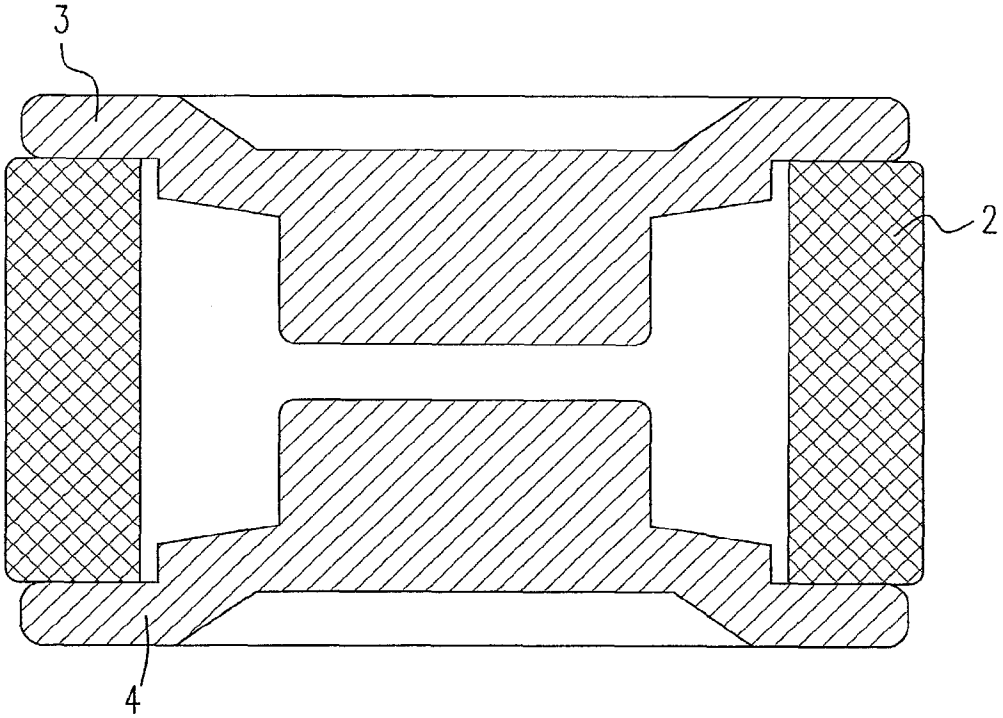
FIG. 1 shows a cross section of a gas discharge tube of the prior art to the present invention.

As shown in FIG. 1, a conventional type of gas discharge tubes includes a pair of end electrodes 3 and 4 and each electrode includes a flange-like base part and at least one hollow cylindrical insulator 2, soldered or attached to the base part of the end electrodes. A coating or an element formed of resistant layers is applied to the screened area on both electrodes. For example, a normal dimension of a gas discharge tube for igniting high pressure xenon lamps is an axial extension of about 6.2 mm and a radial extension of 8 mm. Such tube has an insulating ring with a height of 4.4 mm and can withstand a discharge of several kV using an electrode gap of 0.6 mm.

Figure 2:
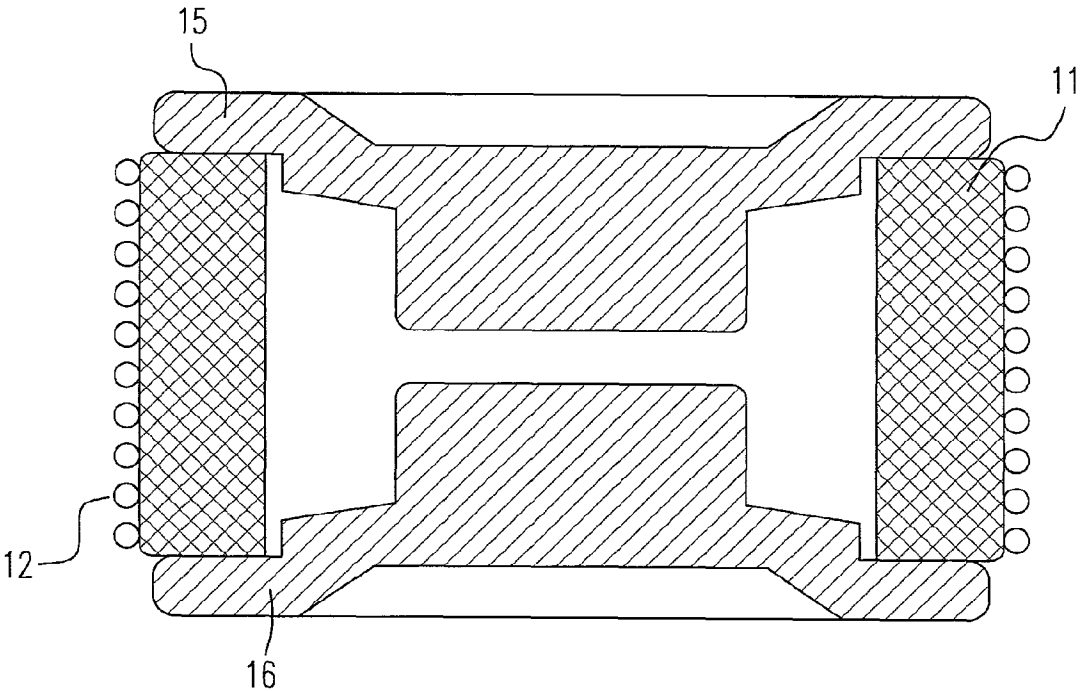
FIG. 2 shows a cross section of an embodiment of a gas discharge tube having an inductive property with a spiral lead according to the present invention.

As shown in FIG. 2, a gas discharge tube with an inductive property or a variable resistance property disclosed in the present invention includes at least two electrodes 15 and 16 and at least one hollow cylindrical insulator 11 fastened to at least one of the electrodes 15 and 16. The feature is that the hollow cylindrical insulator 11 has an inductive property or a variable resistance property, whereby the gas discharge tube consequently has an inductive property or a variable resistance property Preferably, the hollow cylindrical insulator 11 (also referred to as the insulating ring) includes a cylindrical part and a spiral lead 12 formed on the outward of the cylindrical part. The spiral lead 12 can be a cooper, an aluminum, a gold, a silver or other types of metallic lead. In some embodiments, the spiral lead 12 can be a lacquer-enclosed lead having an insulating layer.

Figure 3A:
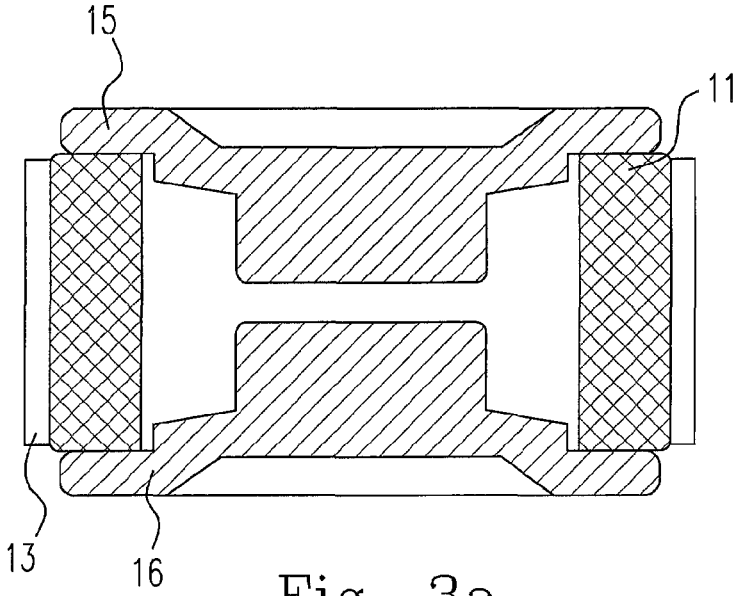
FIGS. 3*a* and 3*b* show cross sections of an embodiment of a gas discharge tube having an inductive property with a spiral conductive coating according to the present invention.
Figure 3B:
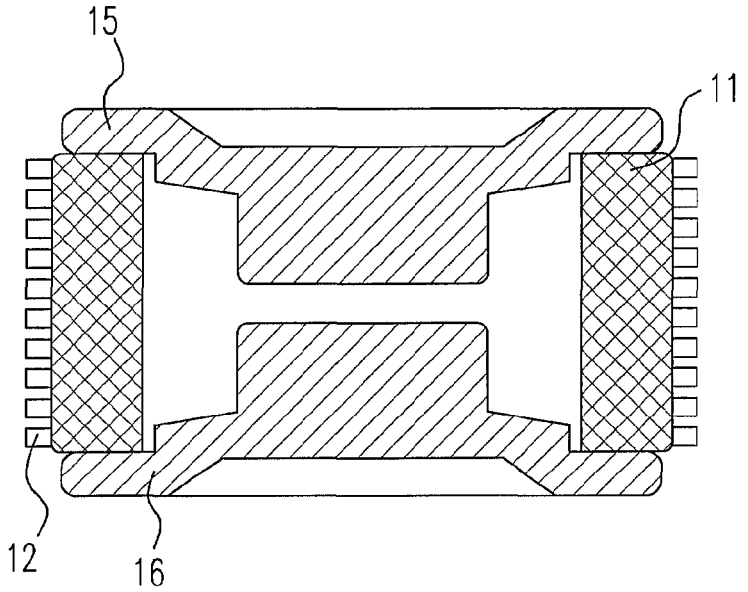

As shown in FIG. 3*a*, preferably, for forming the spiral lead 12, a conductive layer surface 13 is formed on the outward of the cylindrical part of the insulating ring, wherein the layer is coated on the outward of the cylindrical part of the insulating ring by a chemical plating process, a sputtering process or a plasma deposition technique, and then the FIG. 3*b* shows the spiral lead 12 is formed by a process such as a lathe cutting scheme and covered with a smooth glaze to shed dirt (not shown). The conductive layer surface 13 can be a metallic layer, a metallic compound conductive layer, a metallic oxide conductive layer or the like. In some embodiments, it is also applicable to form a chip inductive configuration on the outward of the cylindrical part. By inserting an inductive excess device upon a conventional gas discharge tube, its low pass characteristic will change to a band pass characteristic (e.g.: for 0~300 MHz to 10 kHz~300 MHz) and the inductive excess device will be a benefit to a surge suppress capability in a frequency domain.

Figure 4:
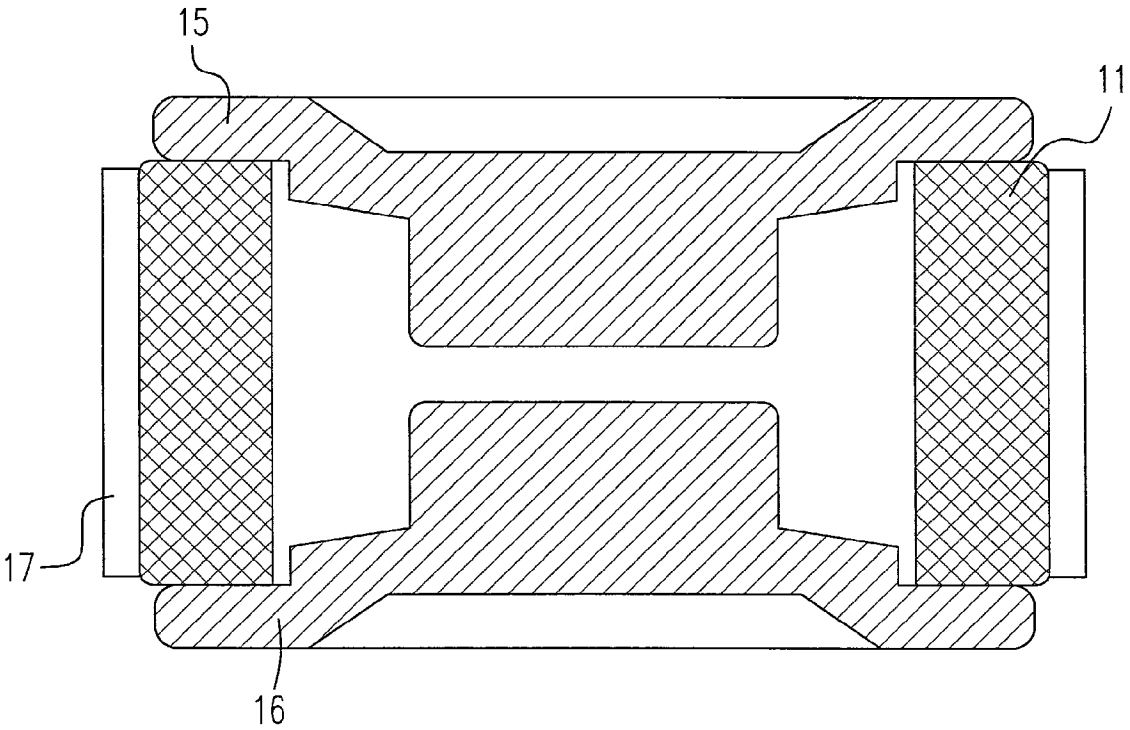
FIG. 4 shows a cross section of an embodiment of a gas discharge tube having a variable resistance property with a metallic oxide variable resistance coating according to the present invention.

As shown in FIG. 4, preferably, a metallic oxide conductive layer 17 is formed with a variable resistance property and covered with a smooth glaze to shed dirt (not shown). It is also applicable to form a chip variable resistance configuration on the outward of the cylindrical part. In some embodiments, inserting a variable resistance on its outmost surface, for example, a 20 volts turn-on device, can initiate a suppression of a voltage surge at a early stage (e.g.: a smallest turn-on voltage range of a gas discharge tube is 75~90 voltage in the present time). Therefore, it is helpful in a time domain to suppress the surge voltage.

Figure 5A:
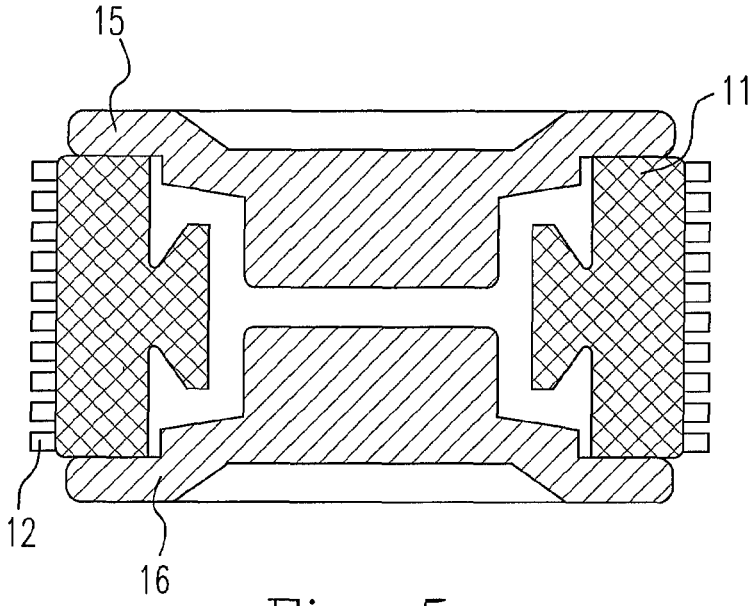
FIGS. 5*a* and 5*b* show cross sections of an embodiment of a gas discharge tube having an inductive property or a variable resistance property with an inwardly extending surface according to the present invention.
Figure 5B:
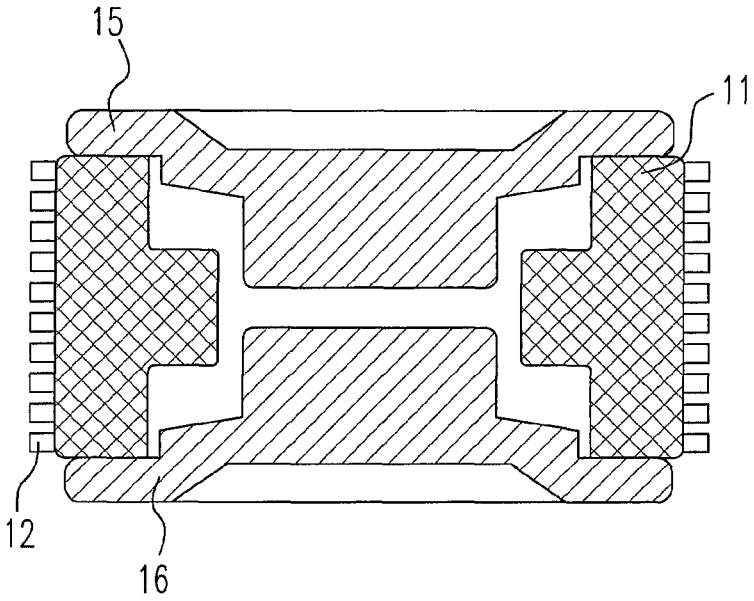

As shown in FIG. 5*a* and FIG. 5*b*, during gas discharge, a sputtering of a metal such as a copper (if an electrode is ionized) may occur and the sputtered metal will condense on the walls of the tube, forming a leakage passage. However, the inwardly extending flange will also create a shadow for the sputtered material to prevent the sputtered material from forming consecutive surfaces which cause the leakage. Thus it further increases the operation life of such discharge tube.

It is preferred that at least a part of the opposite surfaces of the end electrodes is covered with a compound, a element layer or a coating layer to prevent the formation of a oxide layer or other unwanted layers. This compound can be a highly stable metallic alloy or a practically inert metal such as a titanium or a gold. The compound can be a carbonaceous compound such as a carbonaceous compound with an addition of a metal such as a chromium or a titanium. A carbonaceous compound is defined as any polymorph of carbon, for example, a diamond, a diamond-like carbon or a graphite.

According to one embodiment thereof, the inert surface or a oxidation resistant coating or a layer is applied to the electrodes by a chemical plating process, a sputtering process, a plasma deposition techniques or the like, wherein the given is well known to a person skilled in the art. Gases used in gas filling are a nitrogen, a helium, an argon, a methane, a hydrogen, and others as such or in mixtures.

Although the present invention has been described with regard to its preferred embodiments, which constitute the best mode presently known to the inventors, it should be understood that various changes and modifications as would be obvious to one having the ordinary skill in this art may be made without departing from the scope of the present invention which is set forth in the claims appended hereto.

There are further embodiments provided as follows.

Embodiment 1: A gas discharge tube has one of an inductive property and a variable resistance property. The gas discharge tube includes at least two electrodes and at least one hollow insulator. The at least one hollow insulator is fastened to at least one of the at least two electrodes. The at least one hollow insulator has one of the inductive property and the variable resistance property and thereby the gas discharge tube has one of the inductive property and the variable resistance property.

Embodiment 2: In the gas discharge tube according to above-mentioned embodiment, the at least one hollow insulator includes a cylindrical part and a spiral wire. The spiral wire is formed on an outer surface of the cylindrical part.

Embodiment 3: In the gas discharge tube according to above-mentioned Embodiment 1 or 2, the at least one hollow insulator includes a cylindrical part and an inductive chip. The inductive chip is formed on an outer surface of the cylindrical part.

Embodiment 4: In the gas discharge tube according to any one of above-mentioned Embodiments 1-3, the at least one hollow insulator includes a cylindrical part and a variable resistance layer. The variable resistance layer is formed on an outer surface of the cylindrical part.

Embodiment 5: In the gas discharge tube according to any one of above-mentioned Embodiments 1-4, the at least one hollow insulator includes a cylindrical part and a variable resistance chip. The variable resistance chip is formed on an outer surface of the cylindrical part.

Embodiment 6: In the gas discharge tube according to any one of above-mentioned Embodiments 1-5, the spiral wire consists of a metal wire.

Embodiment 7: In the gas discharge tube according to any one of above-mentioned Embodiments 1-6, the spiral wire is cut from a conductive film.

Embodiment 8: In the gas discharge tube according to any one of above-mentioned Embodiments 1-7, the at least one hollow insulator includes an inwardly extending flange.

Embodiment 9: In the gas discharge tube according to any one of above-mentioned Embodiments 1-8, the at least one electrode has a chemical inert surface.

Embodiment 10: In a fabricating process for fabricating a gas discharge tube, the process includes providing at least two electrodes, at least one hollow insulator and a conductive portion. The at least one hollow insulator is attached to at least one of the at least two electrodes. The at least one hollow insulator has a cylindrical part. The conductive portion is formed on a surface of the respective cylindrical part.

Embodiment 11: In the process according to above-mentioned embodiment, the forming step further includes a step of forming a spiral wire to be the conductive portion.

Embodiment 12: In the process according to above-mentioned Embodiment 10 or 11, the spiral lead includes a material being one selected from a group consisting of a copper, an aluminum, a gold and a silver.

Embodiment 13: In the process according to any one of the above-mentioned Embodiments 10-12, the forming step further includes a step of forming a conductive layer on the respective cylindrical part by a deposition scheme.

Embodiment 14: In the process according to any one of the above-mentioned Embodiments 10-13, the deposition scheme is performed by one selected from a group consisting of a chemical plating process, a sputtering process and a plasma deposition process.

Embodiment 15: In the process according to any one of the above-mentioned Embodiments 10-14, the conductive layer is one selected from a group consisting of a metallic layer, a metallic compound conductive layer and a metallic oxide conductive layer.

Embodiment 16: In the process according to any one of the above-mentioned Embodiments 10-15, the process further includes a step of cutting the conductive layer.

Embodiment 17: In the process according to any one of the above-mentioned Embodiments 10-16, the forming step further includes a step of forming a chip inductor.

Embodiment 18: In the process according to any one of the above-mentioned Embodiments 10-17, the forming step further includes a step of forming a varistor layer.

Embodiment 19: In the process according to any one of the above-mentioned Embodiments 10-18, the forming step further includes a step of forming a chip varistor.

Embodiment 20: A gas discharge tube includes at least two electrodes and at least one insulating ring. The at least one insulating ring has one of an inductive property and a variable resistance property. The at least one insulating ring is attached to at least one of the at least two electrodes.

What is claimed is:

1. A gas discharge tube for surge suppression having one of an inductive property and a variable resistance property, comprising:

at least two electrodes;

at least one hollow insulator fastened to at least one of the at least two electrodes, wherein the at least one hollow insulator has one of the inductive property and the variable resistance property for surge suppression, and thereby the gas discharge tube has one of the inductive property and the variable resistance property, wherein the at least one hollow insulator includes a cylindrical part having an outer surface; and one of a spiral wire and an inductive chip is formed on the outer surface.

2. The gas discharge tube according to claim 1, wherein the spiral wire and the at least two electrodes are configured in parallel.

3. The gas discharge tube according to claim 1, wherein the at least one hollow insulator comprises a cylindrical part, further comprising a variable resistance layer formed on an outer surface of the cylindrical part.

4. The gas discharge tube according to claim 1, wherein the at least one hollow insulator comprises a cylindrical part, further comprising a variable resistance chip formed on an outer surface of the cylindrical part.

5. The gas discharge tube according to claim 2, wherein the spiral wire consists of a metal wire.

6. The gas discharge tube according to claim 2, wherein the spiral wire is cut from a conductive film.

* * * * *